US007380919B1

(12) United States Patent
Anderson et al.

(10) Patent No.: US 7,380,919 B1
(45) Date of Patent: Jun. 3, 2008

(54) PROTECTOR FOR AN INKJET CARTRIDGE AND METHOD OF USING THE SAME

(75) Inventors: Stephen Abb Anderson, Thompson's Station, TN (US); William Allen Putman, Franklin, TN (US)

(73) Assignee: Nukote International, Inc., Franklin, TN (US)

( * ) Notice: Subject to any disclaimer, the term of this patent is extended or adjusted under 35 U.S.C. 154(b) by 277 days.

(21) Appl. No.: 10/900,893

(22) Filed: Jul. 28, 2004

(51) Int. Cl.
*B41J 2/17* (2006.01)

(52) U.S. Cl. ..... 347/84; 347/85; 347/86; 347/108

(58) Field of Classification Search ..... 347/108, 347/84–89; 206/204, 576
See application file for complete search history.

(56) References Cited

U.S. PATENT DOCUMENTS 5,365,262 A 11/1994 Hattori et al.
5,373,936 A * 12/1994 Kawai et al. ..... 206/204
5,537,134 A 7/1996 Baldwin et al.
5,748,216 A 5/1998 Scheffelin et al.
5,933,175 A 8/1999 Stathem et al.
6,095,643 A 8/2000 Cook et al.
6,325,500 B1 * 12/2001 Kitabatake et al. ..... 347/86
6,328,424 B1 12/2001 Denton et al.
6,634,732 B2 10/2003 Farr et al.

OTHER PUBLICATIONS

Specification page; Nitto Denko Corporation 2000 ver. 1; Semiconductor Equip, ELEPEP Holder UE-E-2091J—1 page.
Specification page; Nitto Denko Corporation 2000 ver. 1; Semiconductor Equip, ELEPEP Holder UE-E-2092J—1 page.

* cited by examiner

*Primary Examiner*—Manish S Shah
(74) *Attorney, Agent, or Firm*—Fay Sharpe LLP

(57) ABSTRACT

A transport protector for protecting an inkjet cartridge wherein the inkjet cartridge includes a cartridge body, an inkwell extending from the cartridge body and a nozzle on the inkwell. The protector including a protector body shaped to receive at least a portion of the inkjet cartridge and including a section to allow UV radiation to penetrate the protector body and cure a UV sensitive material on the inkjet cartridge.

19 Claims, 10 Drawing Sheets

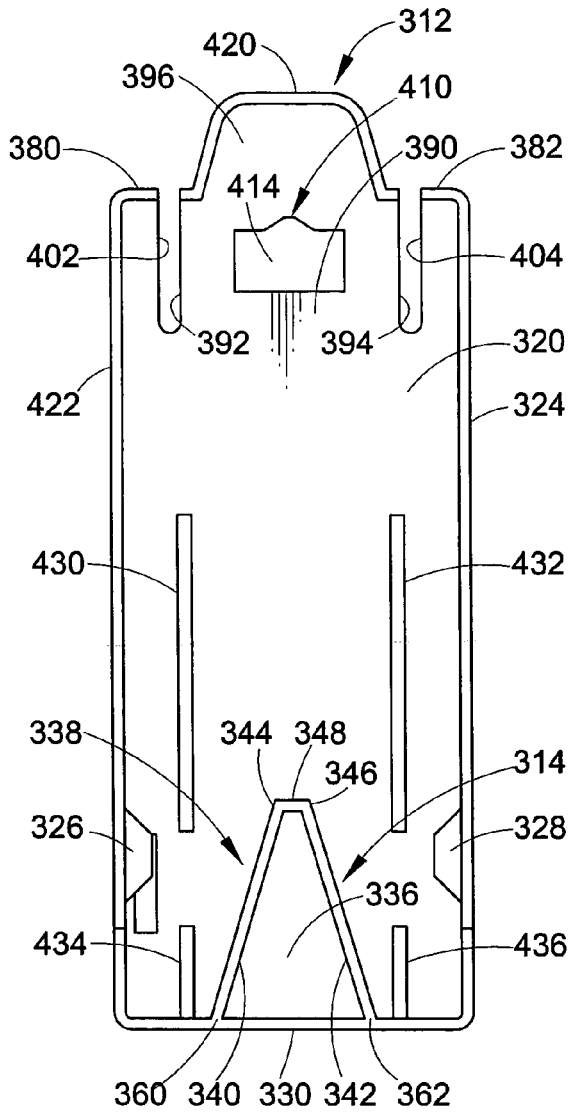
FIG. 15
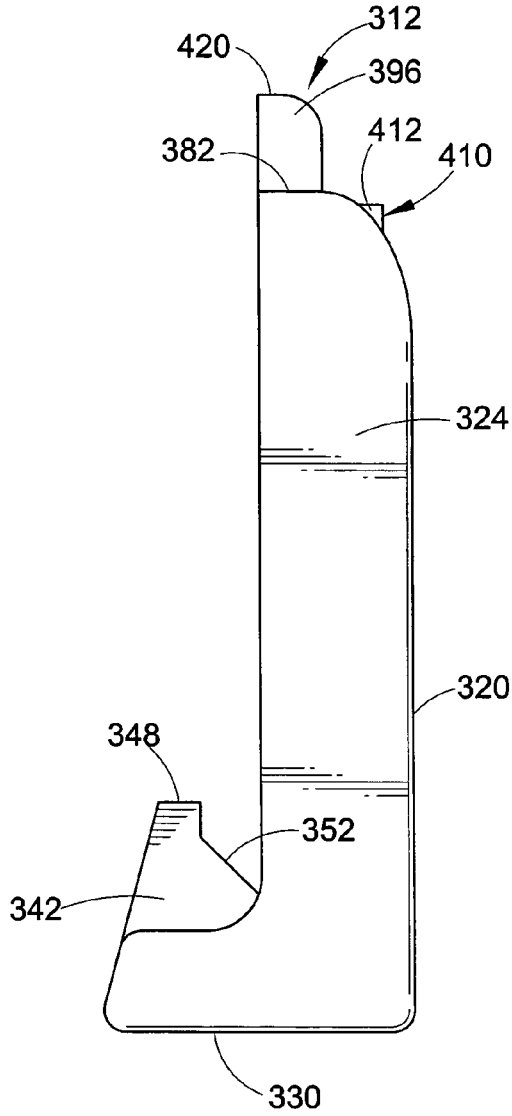
FIG. 16
FIG. 17
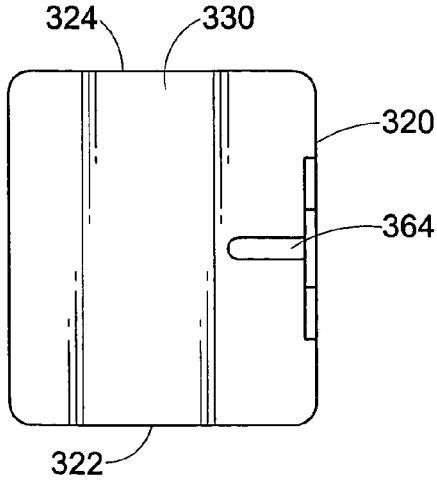

PROTECTOR FOR AN INKJET CARTRIDGE AND METHOD OF USING THE SAME

The present invention relates to the art of packaging and, more particularly, to a protector for protecting an inkjet cartridge during shipping and/or handling.

INCORPORATION BY REFERENCE

The present invention relates to protecting inkjet cartridges. Scheffelin U.S. Pat. No. 5,748,216; Hattori U.S. Pat. No. 5,365,262; Denton U.S. Pat. No. 6,328,424; Cook U.S. Pat. No. 6,095,643; Baldwin U.S. Pat. No. 5,537,134; and Stathem U.S. Pat. No. 5,933,175 disclose inkjet cartridges and are incorporated by reference herein as background information for showing the same. Further, the present invention includes the use of a UV curable material which is shown in two product spec. sheets by Nitto Denko Corporation, code nos. UE-E-2091J and UE-E-2092J, which are also incorporated by reference herein.

BACKGROUND OF THE INVENTION

The present invention is particularly applicable for use in connection with inkjet cartridges and, therefore, the invention will be described with particular reference to an inkjet cartridge. However, the invention has broader applications and may be used in connection with other products.

It is, of course, well known that a cover or protector can be used in connection with product packaging for protecting a delicate portion of a product. Further, it is also well known that the cover can be molded into a desired configuration tailored to cover and protect a desired portion of the product and to help maintain its position relative to the portion to be protected. These devices can be made from a number of different materials which provide shock absorbing qualities that protect the delicate portion of the product during the shipping and/or handling of the product. By utilizing a cover having protective qualities, a lower percentage of products are damaged during shipping and/or handling. This is especially important in relation to electronics which are easily damaged.

It is also known that the ink in an inkjet cartridge can leak or seep from the cartridge during shipping and/or handling of the cartridge. Therefore, it is advantageous to cover the nozzle until the cartridge is ready for use by the end user.

The problem arises in creating a protector that is inexpensive to produce and easy to position relative to the desired zone of protection wherein the end user can easily remove the cartridge from the packaging without damaging the cartridge.

SUMMARY OF THE INVENTION

In accordance with the present invention, a transport protector is provided for protecting the nozzle on an inkjet printer cartridge and also for preventing ink seepage from the nozzle and which is also easy to properly install and easy to remove. In this respect, a transport protector in accordance with the present invention includes a protector body shaped to receive the inkjet cartridge and which allows UV radiation to penetrate the protector body to expose a UV sensitive material on the inkjet cartridge to the radiation. The UV sensitive material can be positioned on the nozzle plate of the cartridge to prevent ink leakage.

In accordance with another aspect of the present invention, a method of protecting an inkjet cartridge is provided wherein a UV sensitive material is applied to an inkjet cartridge and then, the UV sensitive material is exposed to a UV radiation source while the cartridge is in the protector to change the physical properties of the UV material at a desired point in the production, shipping and/or handling of the inkjet cartridge.

BRIEF DESCRIPTION OF THE DRAWINGS

The foregoing and more will in part be obvious and in part be pointed out more fully hereinafter in connection with a written description of preferred embodiments of the present invention illustrated in the accompanying drawings in which:

FIG. 15 is a rear elevational view of the transport clip shown in FIG. 13;

FIG. 16 is a left-side elevational view of the transport clip shown in FIG. 13;

FIG. 17 is a bottom plan view of the transport clip shown in FIG. 13;

DESCRIPTION OF PREFERRED EMBODIMENTS

Figure 1:
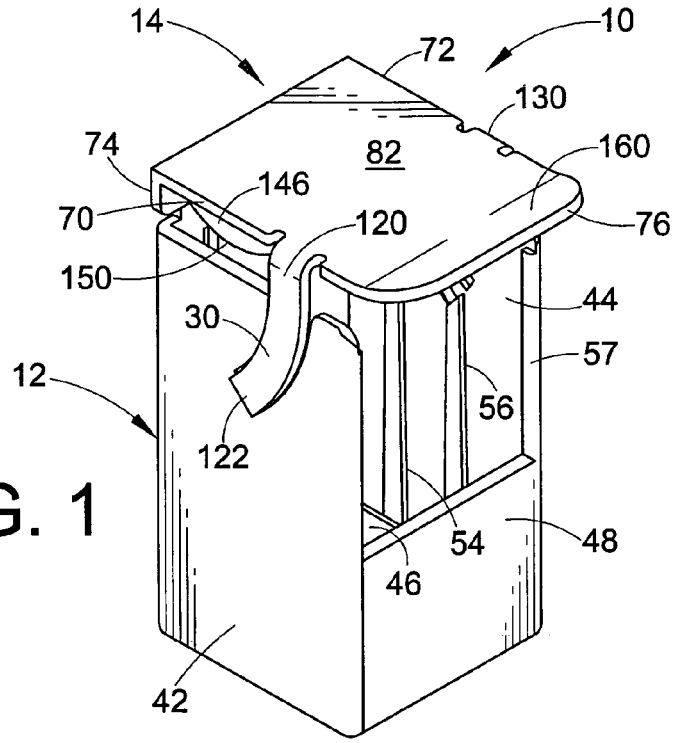
FIG. 1 is a rear perspective view of a transport protector for an inkjet cartridge in accordance with the present invention wherein the protector is in a closed condition.
Figure 2:
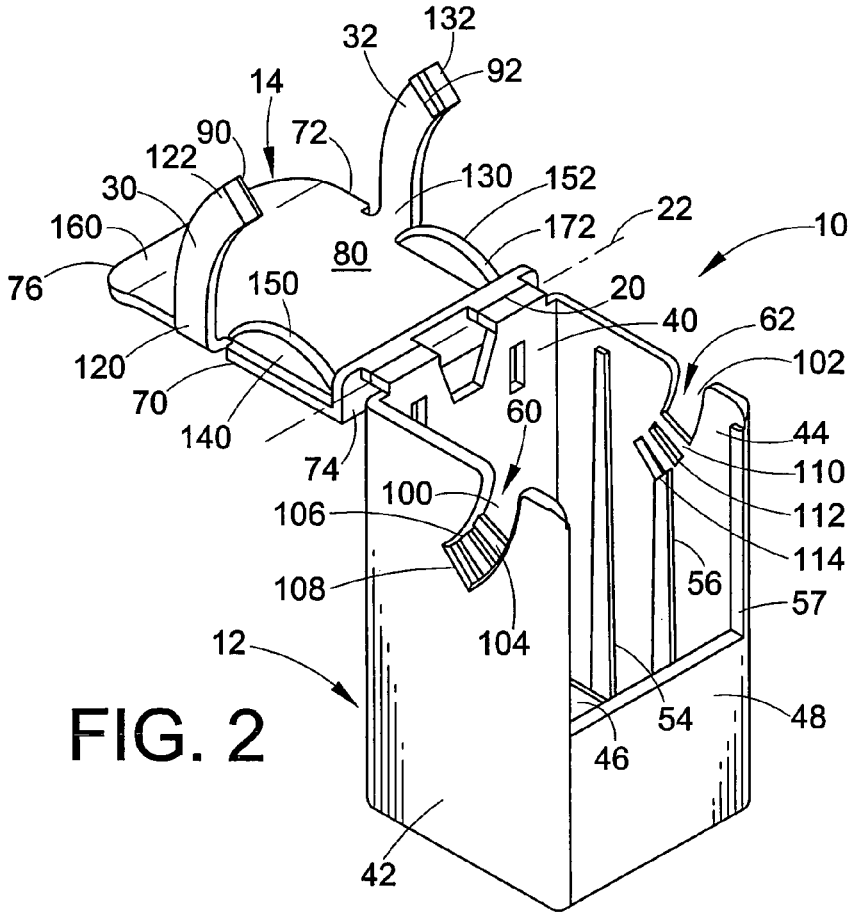
FIG. 2 is a rear perspective view of the protector shown in FIG. 1 wherein the protector is in an opened condition.
Figure 3:
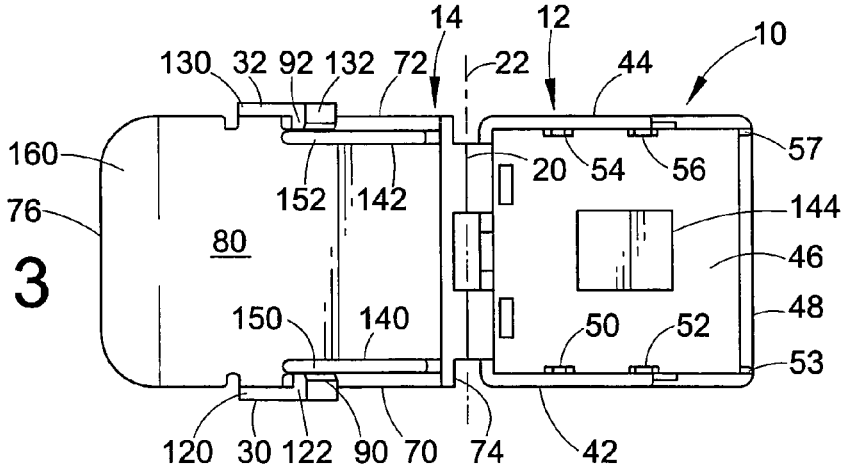
FIG. 3 is a top plan view of the protector shown in FIG. 1 shown in the opened condition.
Figure 4:
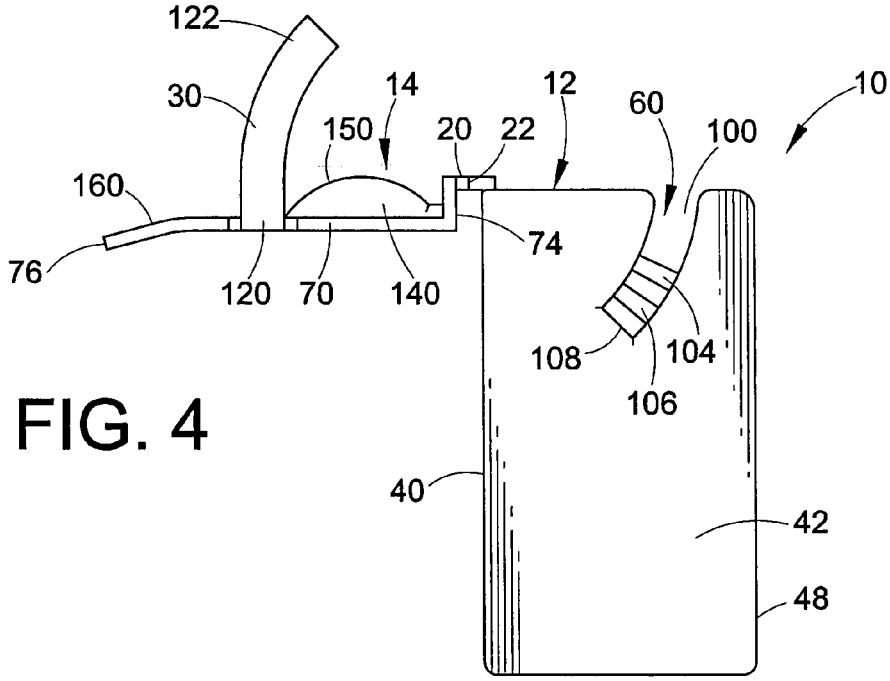
FIG. 4 is a right-side elevational view of the protector shown in FIG. 1 shown in the opened condition.
Figure 5:
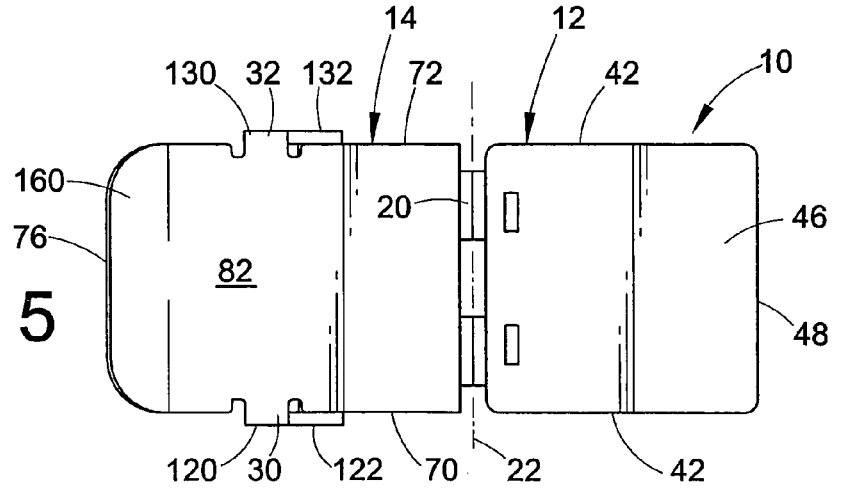
FIG. 5 is a bottom plan view of the protector shown in FIG. 1 shown in the opened condition.
Figure 6:
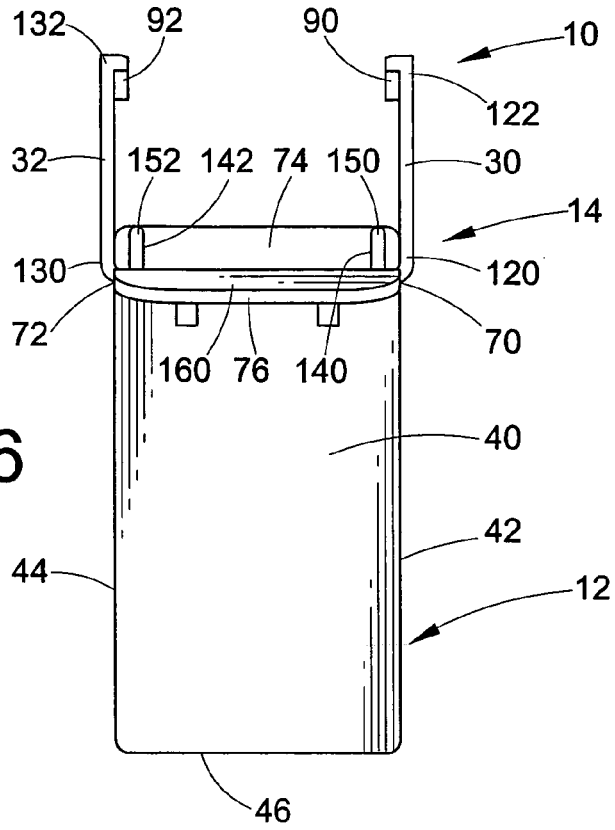
FIG. 6 is a front elevational view of the protector shown in FIG. 1 shown in the opened condition.
Figure 7:
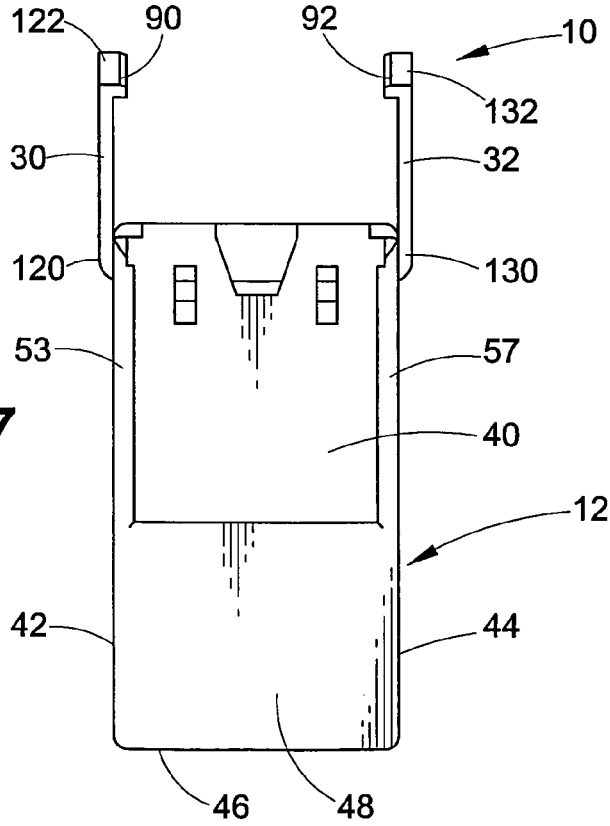
FIG. 7 is a rear elevational view of the protector shown in FIG. 1 shown in the opened condition.
Figure 8:
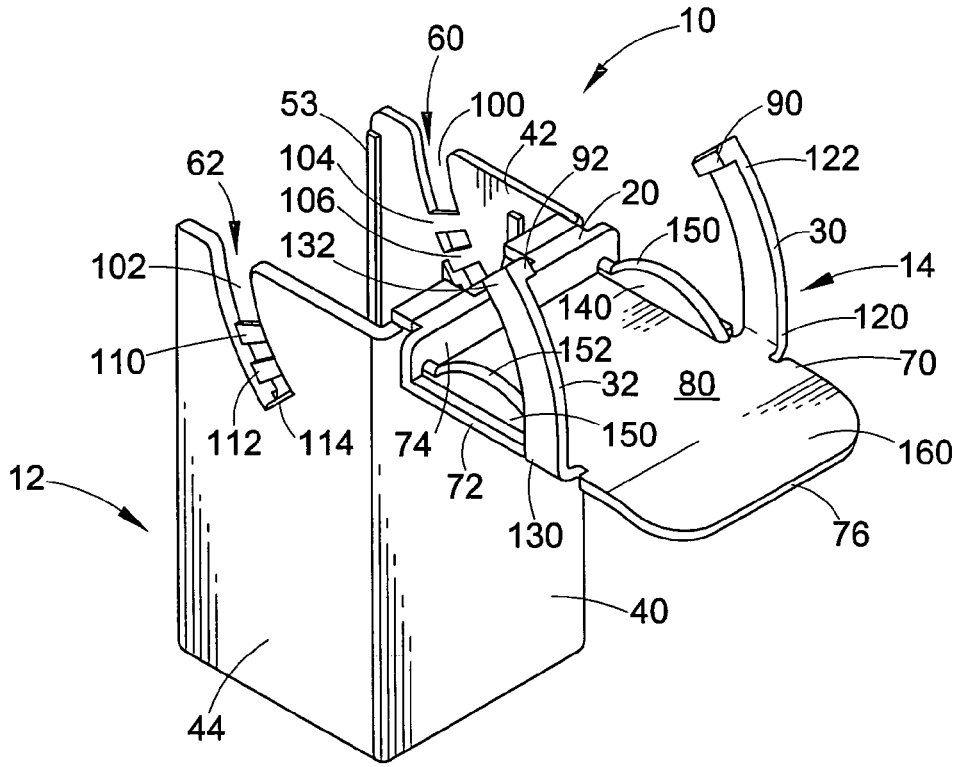
FIG. 8 is a front perspective view of the protector shown in FIG. 1 shown in the opened condition.
Figure 9:
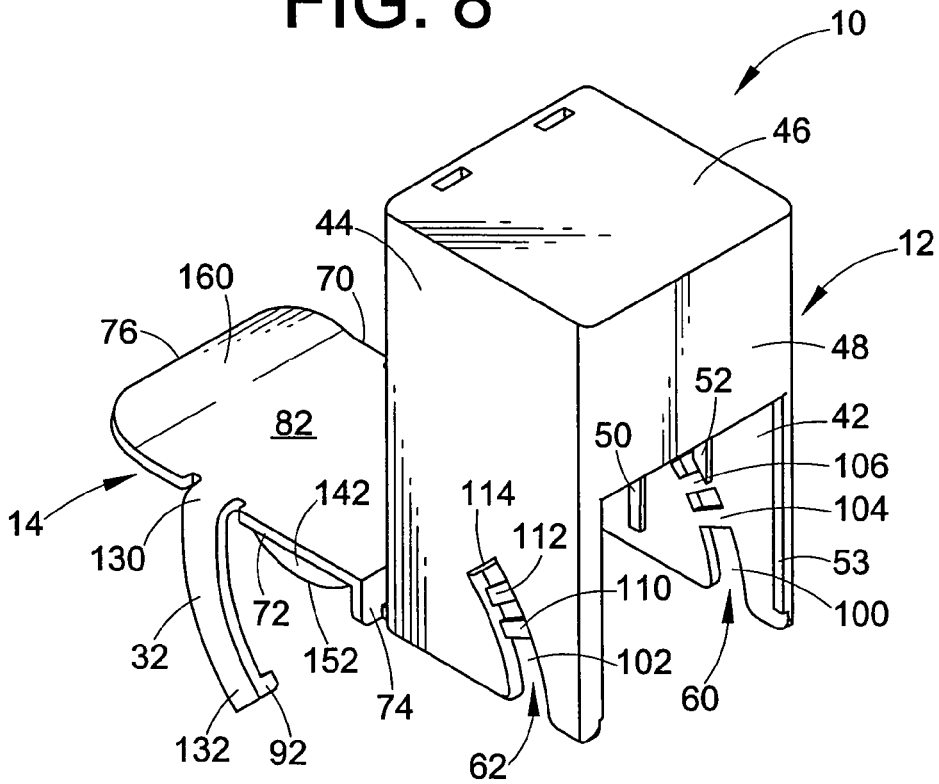
FIG. 9 is a rear bottom perspective view of the protector shown in FIG. 1 shown in the opened condition.
Figure 10:
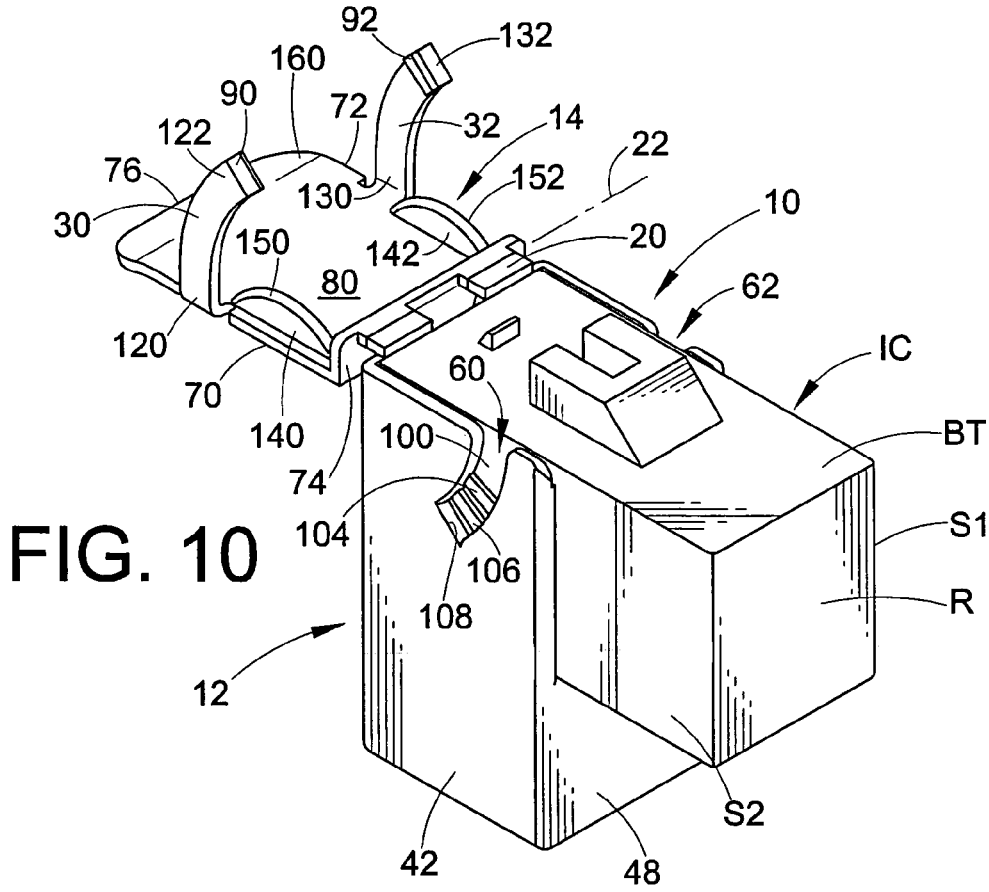
FIG. 10 is a rear perspective view of the protector shown in FIG. 1 with an inkjet cartridge in place wherein the protector is shown in the opened condition.
Figure 11:
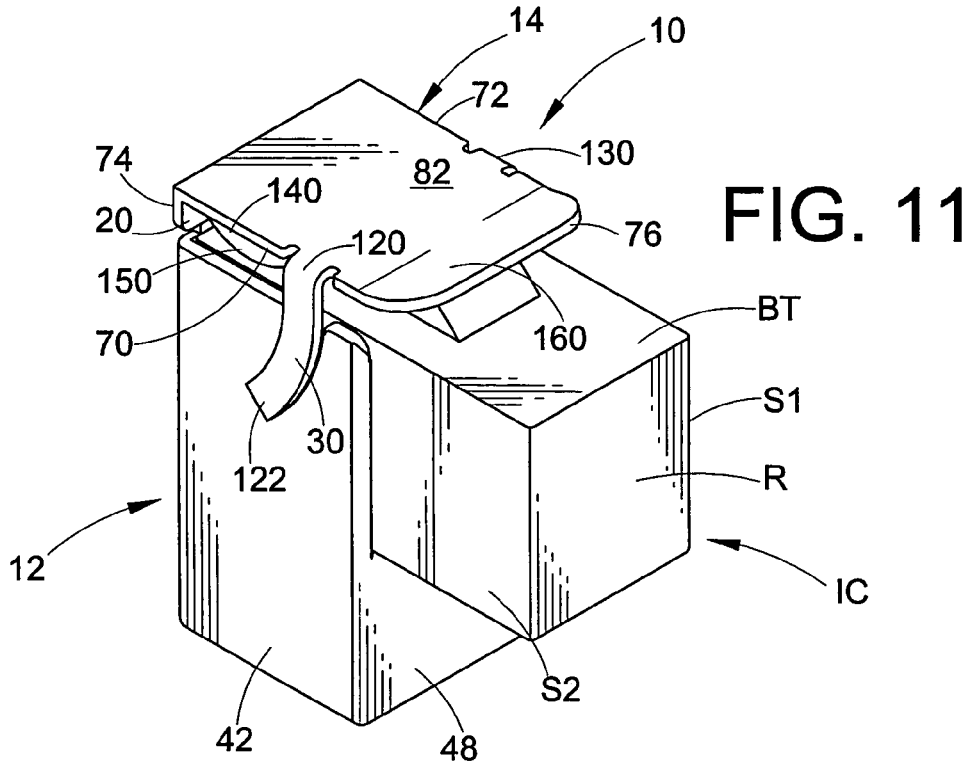
FIG. 11 is a rear perspective view of the protector shown in FIG. 10 wherein the protector is in the closed condition.

Referring now in greater detail to the drawings wherein the showings are for the purpose of illustrating preferred embodiments of the invention only and not for the purpose of limiting the invention, FIGS. 1-11 illustrate a transport protector 10 having a transport or protector body 12 and a lid 14 hingedly connected to body 12. In this respect, lid 14 is joined to body 12 at a hinge 20 wherein hinge 20 can be any hinge known in the art to allow pivoting or hinging movement of one component relative to another component. Hinge 20 allows lid 14 to pivot relative to body 12 about a hinge axis 22. Furthermore, lid 14 includes a lid lock including locking arms 30 and 32 to maintain lid 14 relative to body 12 in a desired locked position or closed condition. By utilizing hinge 20 and locking arms 30 and 32, lid 14 can pivoted from the opened condition shown in FIG. 2 to the closed condition shown in FIG. 1 by rotation about hinge axis 22 wherein locking arms 30 and 32 maintain protector 10 in the closed condition shown in FIG. 1. However, it should be appreciated that modifications to this locking arrangement can be made to lock lid 14 relative to body 12 without detracting from the invention of this application. Further, locking arms 30 and 32 can include a ratcheting mechanism to allow the lid to lock in one of several locking positions which will also be discussed in greater detail below.

Turning to body 12, the body is configured to receive a portion of an inkjet cartridge IC (see FIGS. 10, 11 and 20) to retain the cartridge in a secured condition wherein the delicate components of the inkjet cartridge are protected. Protector 10 is also configured to help prevent the printing ink(s) from leaking from the cartridge during shipping and/or handling. As can be appreciated, ink that seeps or leaks from the cartridge can cause clogging of the nozzle and, therefore, it should be prevented. As can also be appreciated, the shape of protector 10 is, in large part, dictated by the configuration of the particular inkjet cartridge to be protected. Further, the figures of this application show a protector designed to work in connection with a particular inkjet cartridge. However, protector 10 can be shaped and configured differently to work in connection with other inkjet cartridges and/or multiple cartridges. For the discussion of this application, protector is configured to protect the inkjet cartridge IC.

In greater detail, body 12 includes a face plate 40 with side walls 42 and 44 extending rearwardly from the side edges of the face plate. Body 12 further includes a bottom 46 also extending rearwardly from face plate 40. Bottom 30 can also extend between side walls 42 and 44. As discussed above, face plate 40, side walls 42, side wall 44 and bottom 46 are shaped in view of the configuration of inkjet cartridge IC, and further, these components are shaped to receive an ink well IW of inkjet cartridge IC along with a front portion of the inkjet cartridge. Body 12 can further include a rear wall 48 extending between sides 42 and 44 to further protect the ink well components.

Figure 20:
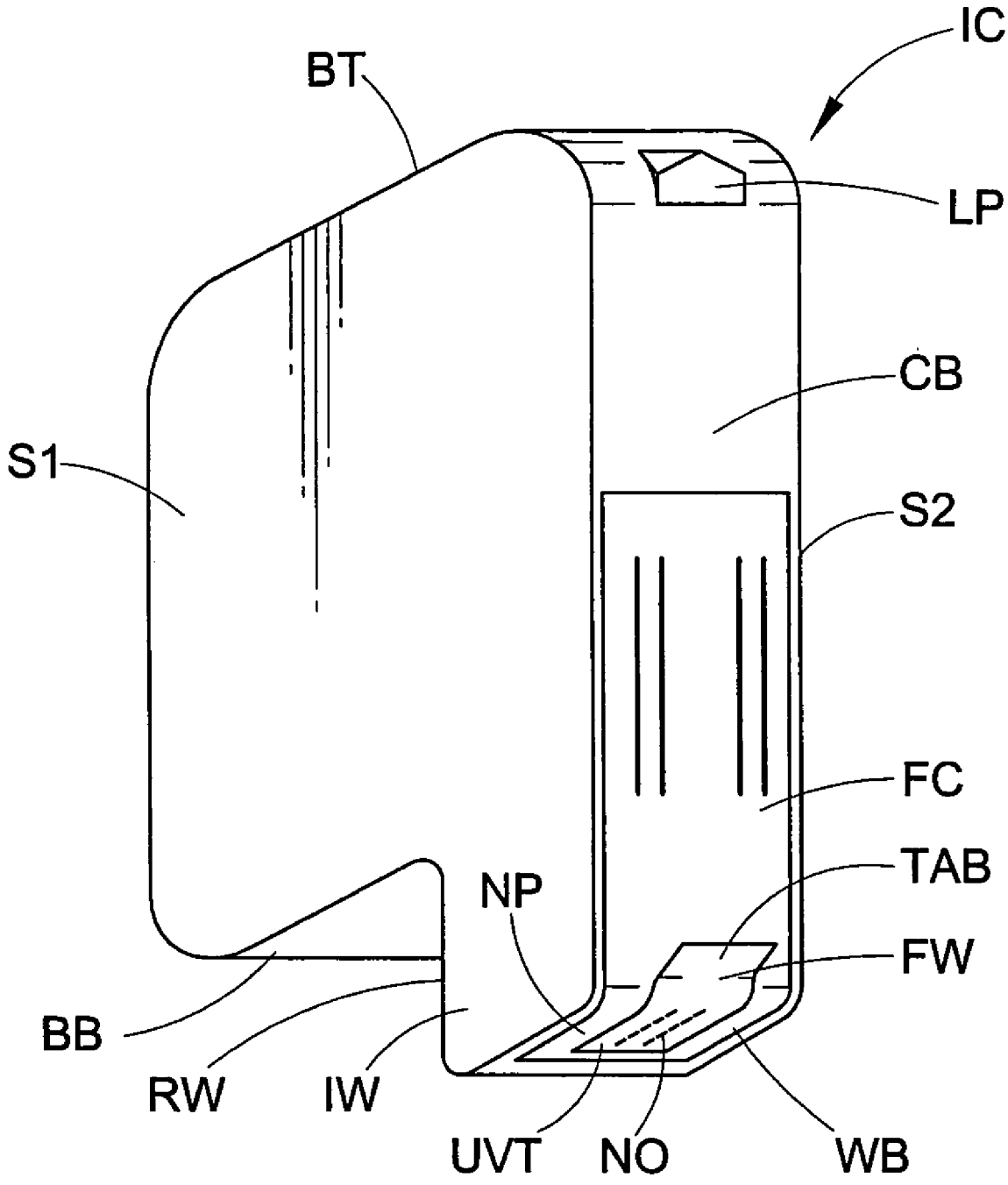

Protector body 12 and/or lid 14, in one embodiment, is made from a UV transparent material and/or includes a UV transparent section to allow UV radiation to penetrate protector 10 and expose a UV curable material UVT on cartridge IC (FIG. 20). The "UV curable" material includes an adhesive that secures the material to the nozzle or nozzle plate NP of cartridge IC. This material can be a UV sensitive tape such as a UV tape produced by Nitto Denko, Corporation under product code UE-E-2091J. The adhesive of this tape looses some or all of its adhesive properties when exposed to UV light. As a result, material UVT can be placed over nozzle plate NP at any time during the manufacturing and/or the handling of the cartridge. The adhesive properties of the material UVT can be such that the material is securely fastened to the nozzle plate. However, once the cartridge is properly positioned within protector 10, the material is exposed to UV radiation to change a property of the material such as to reduce the adhesive properties of the material thereby allowing the end user to easily remove the material from the nozzle plate without damaging the nozzle plate. As can be appreciated, the desired adhesive properties of material UVT during shipping and/or handling are different than the desired adhesive properties of material UVT when the cartridge is in the hands of the end user.

Essentially, the UV material or tape has a high tack before it is exposed to UV radiation. This quality allows the tape to be applied to the nozzle plate and it effectively prevents ink seepage. However, the high tack can dislodge the nozzle plate when the UV material is removed by the end user. Therefore, it is advantageous to utilize the high tack during shopping and/or handling of the cartridge. Then, subsequently, reduce the tack before the end user removes the tape. This can include reducing the tack soon after the cartridge is properly positioned in the transport protector and/or exposing the UV material at a point during and/or after shipping. In this respect, an inkjet cartridge can have an internal positive pressure during air shipments. As can be appreciated, the potential for ink seepage is therefore heightened during air shipments. Therefore, by using a UV material to prevent ink seepage, the high tack of the UV material can even be retained until after the cartridge is air shipped.

In another embodiment, the UV material is lengthened such that it extends beyond the nozzle plate and is adhesively bonded to the outer structure of the inkjet cartridge. Then, as will be discussed in greater detail below, the UV radiation is masked such that it only reaches the UV material directly on the nozzle plate. As a result, the high tack is maintained on the cartridge body to maintain the UV material in place while the UV material has a low tack on the nozzle plate. Again, the low tack on the nozzle plate reduces the likelihood of damage when the end-user removes the tape while maintaining engagement with the nozzle to help prevent ink seepage. As with all embodiments, the step of exposing the UV material can take place at any point during the shipping and/or handling of the inkjet cartridge.

Further, modifications can be made to protector 10 to provide other protective qualities and/or other desired features without detracting from the invention of this application. For example, protector 10 can include reinforcing and/or protecting ribs in body 12 and/or lid 14. In this respect, side 42 can include side ribs 50, 52 and 53 and side 44 can include side ribs 54, 56 and 57. By including these ribs, protector 10 can afford a greater degree of protection for the inkjet cartridge IC by spacing sides 42 and 44 from sides S1 and S2, respectively, of inkjet cartridge IC. Further, these ribs can provide a frictional engagement with sides S1 and S2 of the inkjet cartridge IC to produce a snug fit between the protector and the inkjet cartridge without the tendency of the inkjet cartridge IC becoming wedged in body 12. While not shown, face plate 40 and rear wall 48 can also include similar ribs.

Sides 42 and 44 can further include a mating locking arrangement for locking arms 30 and 32 of lid 14 discussed above. In this respect, locking arms 30 and 32 extend toward body 12 and can selectively engage a pair of locking notches 60 and 62, respectively, that are formed in sides 42 and 44. The engagement between the arms and the notches maintain lid 14 in the locked or closed condition. More particularly, lid 14 includes side edges 70 and 72 which extend from a lid base 74. Sides 70 and 72 are essentially parallel to one another and extend to a lid outer edge 76. Lid 14 further includes a bottom surface 80 and a top surface 82. Arms 30 and 32 extend downwardly from bottom surface 80. Arms 30 and 32 are at or near sides 70 and 72, respectively, and include inwardly facing locking protrusions 90 and 92, respectively, that are shaped to engage a respective one of notches 60 and 62 to create the selective locking engagement. Notches 60 and 62 can have many locking configurations including, but not limited to locking recesses (not shown) in the respective sides of body 12 and/or open locking slots having an upper opened portion 100 and 102, respectively, with one or more locking bars extending transversely across the slots. The locking protrusions of arms 30 and 32 can be configured to engage the bars to maintain lid 14 in the locked condition. In this respect, with reference to locking notch 60, included are locking bars 104 and 106 which can be spaced from one another to allow locking protrusion 90 to at least partially penetrate the opening between the bars and/or the opening between locking bar 106 and a notch base 108. In similar fashion, notch 62 can include two locking bars 110 and 112 which are spaced from one another and are spaced from a notch base 114. As can be appreciated, while two locking bars are shown for each notch, more or less than two locking bars can be utilized. However, by using more than one locking bar, and/or locking engagement point, a ratcheting action can be created that produces multiple locking positions which are helpful to account for manufacturing variances and to allow the protector to be used in connection with more than one inkjet cartridge.

In addition, notches 60 and 62 can be curved and arms 30 and 32 can be curved to improve the locking engagement therebetween. In this respect, locking arm 30 is attached to lid 14 at a base 120 that is at or near lid side 70. Arm 30 extends from base 120 to an end 122 and is curved with a radius generally equal to the distance between the locking arm and hinge axis 22. By having such a curved configuration, all portions of arm 30 are at an equal distance from the pivot point of lid 14 and are maintained at the equal distance as lid 14 pivots about axis 22. Notch 60 has a similar curved configuration. As a result, locking protrusion 90 can be maintained in transverse alignment with notch 60 and will follow the notch as the lid is pivoted relative to the body. In similar fashion, locking arm 32 can be at or near lid side 72 and can extend from an arm base 130 to an arm end 132. Locking arm 32 can also include the same curved configuration as locking arm 30 and notch 62 can include the same curved configuration as notch 60. However, it should be appreciated that arm 30 and notch 60 do not need to be identical to arms 32 and notch 62, respectively. For example, arm 30 and notch 60 can be spaced differently from axis 22 than arm 32 and notch 62 based on the configuration of the inkjet cartridge.

In order to create even downward pressure or force on cartridge IC, lid 14 can include downward pressure ribs 140 and 142. This feature works in connection with material UVT to minimize the possibility of ink leakage. In this respect, material UVT can be used to prevent ink leakage before cartridge is positioned in protector 10. The adhesive properties of the UVT alone maintain the tape on the nozzle plate. Once cartridge IC is in place in protector 10 and nozzle pad 144 is in engagement with nozzle plate NP, nozzle pad 144 will help maintain material UVT relative to the nozzle plate to prevent ink leakage. Therefore, material UVT no longer needs the same adhesive properties to maintain its position on the nozzle plate. The engagement by pad 144 alone can be used to prevent ink leakage once the cartridge is in place in protector 10. Nozzle pad 144 can be a translucent silicon pad which allows UV radiation to penetrate the pad and expose material UVT thereby reducing the tack of the material only after the nozzle pad is firmly in place. As can be appreciated, since pad 144 functions at least in part to maintain the position of material UVT and/or prevent ink leakage, an even force between the printer nozzle and nozzle pad 144 is advantageous.

Ribs 140 and 142 can be spaced on either side of bottom surface 80. This helps produce the even or uniform downward engagement force between lid 14 and the inkjet cartridge when protector is in the closed condition. This rib arrangement also prevents rocking of the cartridge relative to protector 10. Pressure ribs 140 and 142 can also include an arcuate engagement surface 150 and 152, respectively, to produce precise point contact between the respective ribs and body top BT of the inkjet cartridge IC which also accounts for variations in the manufacturing processes of the inkjet cartridge and/or protector 10. It should be appreciated that while the ribs are shown near lid sides 70 and 72, these ribs can be spaced from the side edges of the lid. As can also be appreciated, while a wider spacing is preferred, the precise spacing may be dictated by the shape of the inkjet cartridge. Lid 14 can also include a finger grip extension 160 at or near lid outer edge 76 that at least partially extends away from inkjet cartridge IC when in the closed condition.

In the following discussions concerning yet further embodiments of the present invention, the components of the protector and/or inkjet cartridge which remain the same, as discussed above, will include the same reference numbers.

Figure 12:
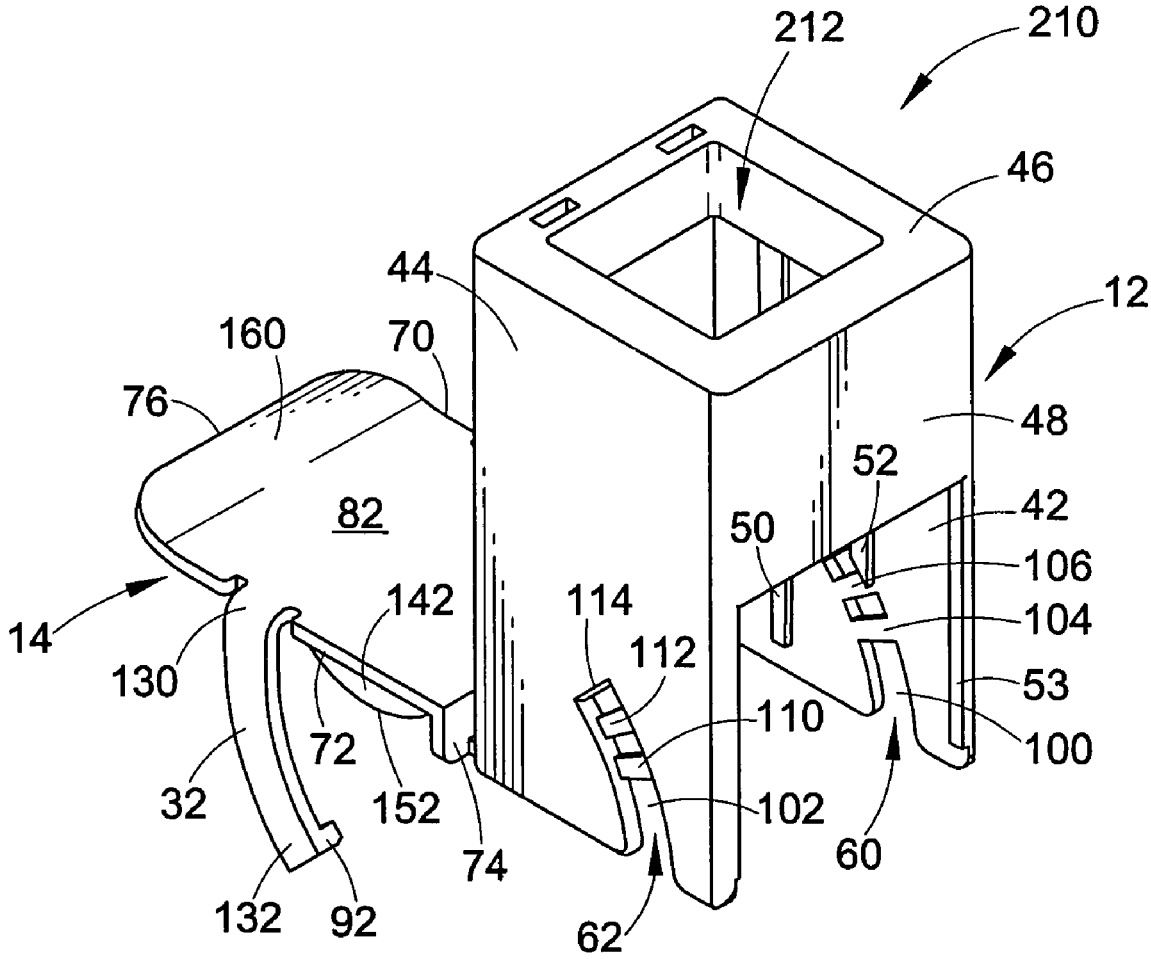
FIG. 12 is a rear bottom perspective view of another embodiment of a transport protector for an inkjet cartridge in accordance with the present invention.
Figure 14:
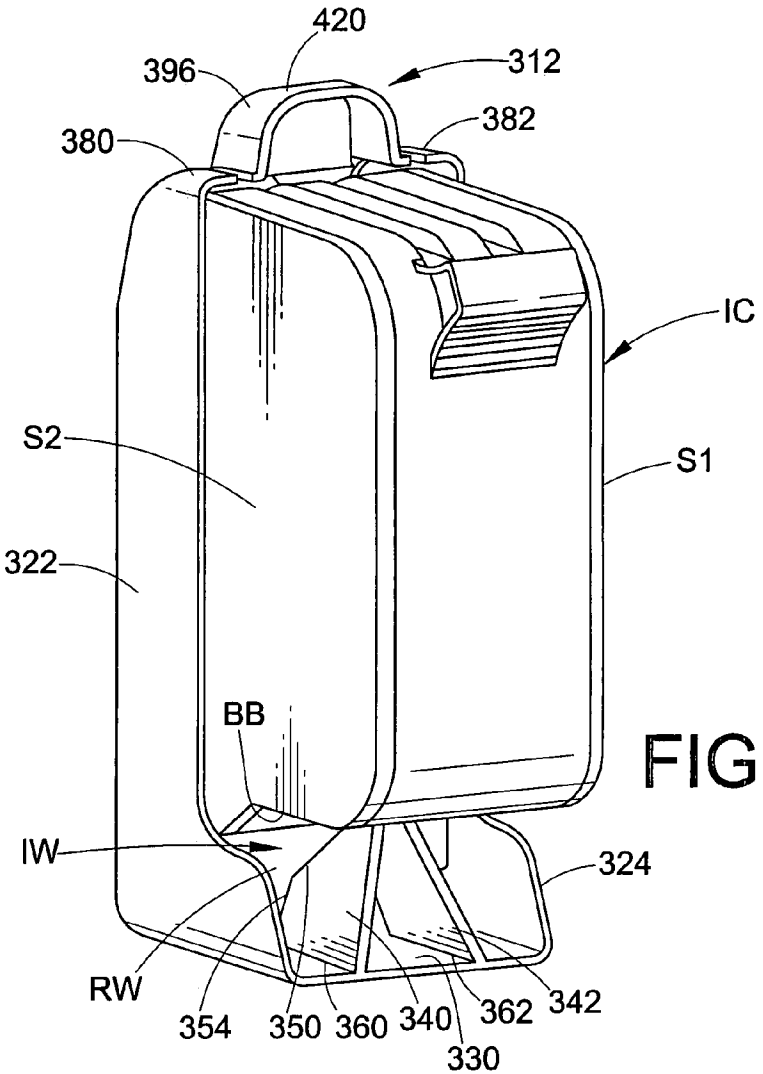
FIG. 14 is a perspective view of the transport protector shown in FIG. 13 which includes an inkjet cartridge in a secured condition.
Figure 13:
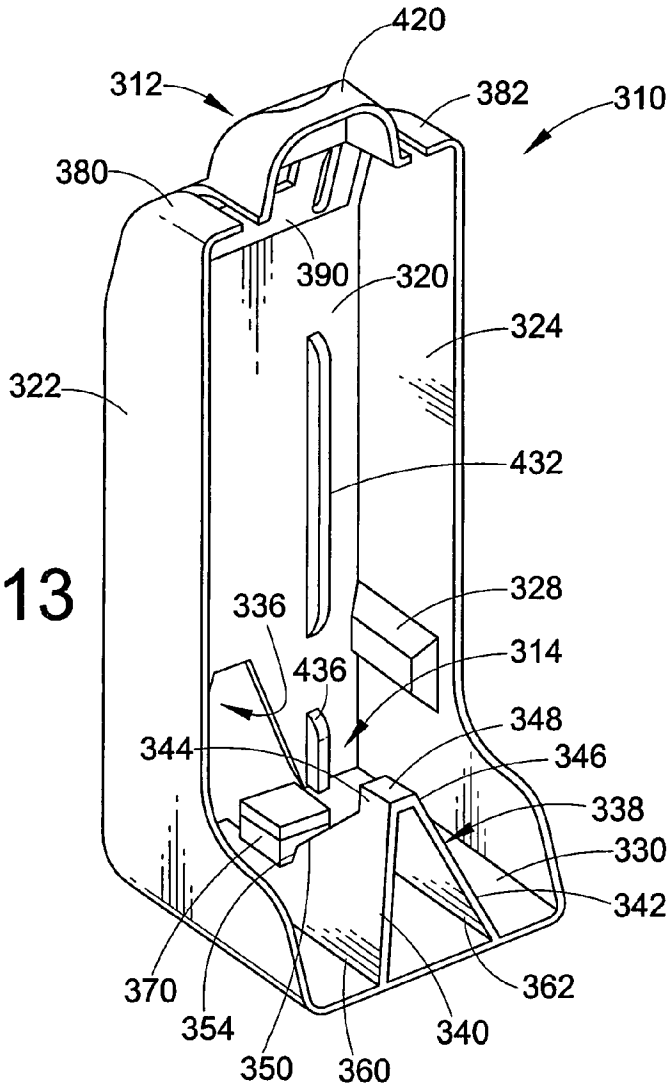
FIG. 13 is a rear perspective view of yet another embodiment of a transport protector for an inkjet cartridge in accordance with the present invention.
Figure 18:
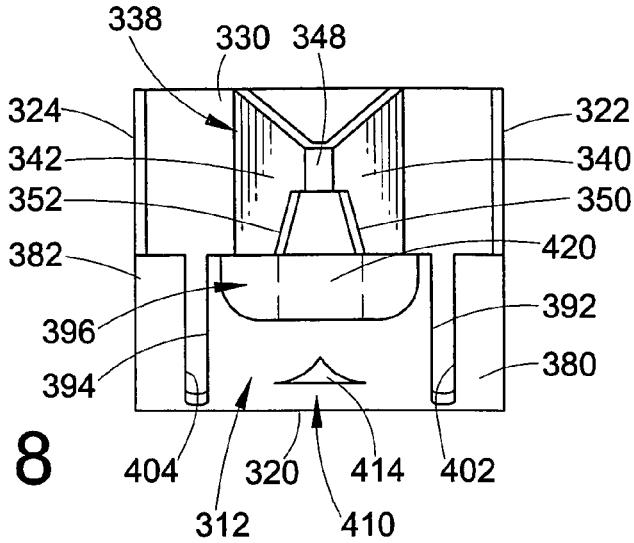
FIG. 18 is a top plan view of the transport clip shown in FIG. 13.
Figure 19:
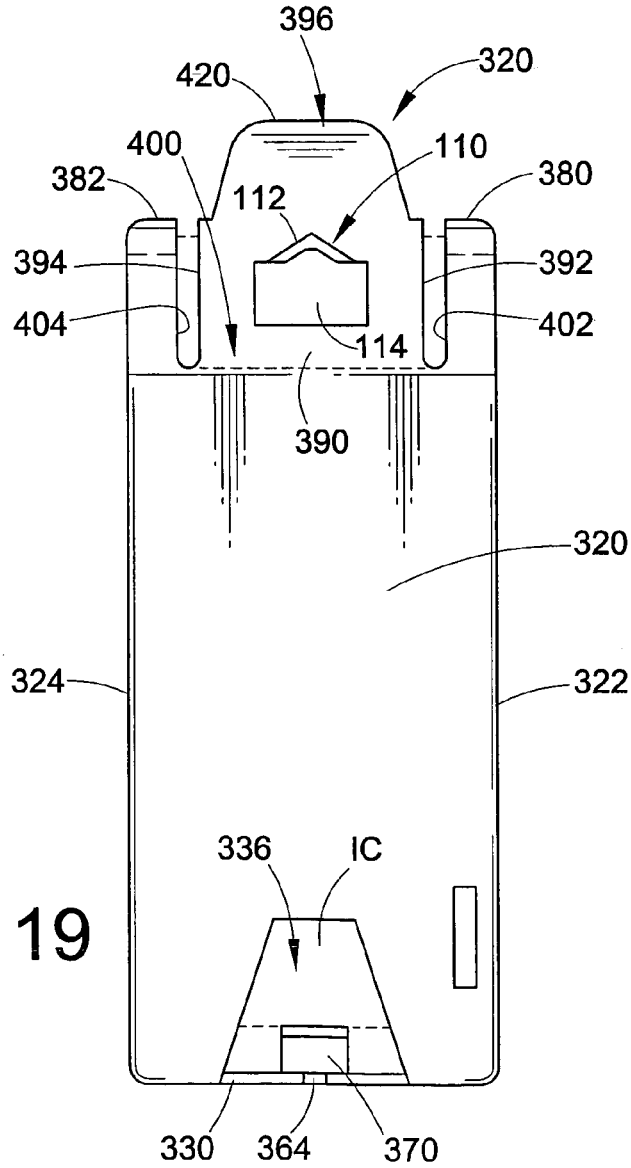
FIG. 19 is a front elevational view of the transport clip shown in FIG. 13; and, FIG. 20 is a perspective view of an inkjet cartridge.

With reference to FIG. 12, shown is a protector 210 which can include one or more of the features discussed above. However, protector 210 includes an opening or open section 212 for UV penetration such that protector 210 can be made from any material regardless of whether the material is UV transparent. Further, open section 212 can function as a mask to limit the exposure by the UV radiation. As stated above, the UV material can extend beyond the nozzle plate wherein opening 212 allows the UV radiation to cure or reduce the tack of only the portion of UVT that is in contact with the nozzle plate. The remaining portions that are in contact with the cartridge body can retain their high tack properties. This prevents damage to the nozzle plate when the UVT is removed while retaining good adhesive contact with the cartridge. More particularly, the positioning and/or shape of section 212 is configured to direct UV radiation to the desire point of exposure of the UV sensitive material inside the protector, which is also referred to as masking. As is stated above, the UV exposure can be used to reduce the adhesion of a UV curable tape after the cartridge is properly positioned in the protector. However, the adhesive property of all the UVT material does not need to be reduced after the cartridge is in position in the protector. In this respect, a portion of the UVT tape or material on the nozzle plate can remain uncured to maintain the tape relative to the nozzle plate and/or seal the nozzle plate. The portion which is not cured can be a small portion that still allows the tape to be easily removed. As can be appreciated, this selective curing or masking can be performed on any of the embodiments of this application. Further, any embodiment of this application can include UVT with a finger tab TAB that further aids the removal of the UVT material by the end user. With respect to Protector 10, a separate mask can be used and/or the UV transparent portion of the protector can be a small window like section in the protector.

With reference to FIGS. 13-19, shown is a protector 310 having a flexible latch 312 instead of the lid discussed above. However, as with the embodiments above, protector 310 is a unified body structure and includes a pocket or recess 314 configured to receive an inkjet cartridge such as inkjet cartridge IC in FIG. 20. More particularly, protector 310 has a face plate 320 with side walls 322 and 324 extending rearwardly from the side edges of the face plate. Protector 310 further includes a bottom 330 that extends rearwardly from the bottom edge of the face plate and which extends between side walls 322 and 324. Face plate 320, side walls 322 and 324, and bottom 330 are shaped to receive a front portion of inkjet cartridge IC. As can be appreciated, the configuration of these components is dependent on the shape and size of the inkjet cartridge. Inkjet cartridges of different configurations require a transport protector having a different size and shape.

Side walls 322 and 324, face plate 320 and bottom 330 are configured based on the protection which is desire for the inkjet cartridge. If ink leakage is the only concern addressed by protector 310, these components can be minimized. For maximum protection, these components can fully cover the inkjet cartridge. Further, sides 322 and 324 can also be configured to work with latch 312 and pocket 314 to maintain inkjet cartridge IC in the secured condition. In this respect, the sides can function to help prevent lateral movement of inkjet cartridge IC relative to protector 310. This, in combination with the frictional engagement between latch 312 and pocket 314, securely maintain inkjet cartridge IC in the secured condition. Sides 322 and 324 can also include friction ribs 326 and 328 to further help maintain clip 320 in the secured condition. However, inkjet cartridge IC should be easily positionable within the secured condition and easily removed from the secured condition and, therefore, sides 322 and 324 can be partial walls such that they extend only partially across sides S1 and S2 of inkjet cartridge IC to promote ease of use.

Pocket 314 further includes a UV opening 336 to allow the UV radiation to reach the UV sensitive material UVT. Again, as with the embodiments discussed above, opening 336 can be shaped and/or the UV radiation can be directed such that only a portion of material UVT is cured by exposing protector 310 and cartridge IC to the UV radiation. For example, while opening 336 is a large opening allowing full exposure by the UV radiation, opening 364 can also be used which focuses the UV radiation to a specific portion of the UVT. To add additional protection and function, pocket 314 can include flexible locking member 338 having flexible ribs 340 and 342 which extend upwardly from bottom 330 to a top edge 344 and 346, respectively. Ribs 340 and 342 can be joined by cross member 348 and can include lead-in tapers 350 and 352, respectively, to help guide the inkwell IW into pocket 314. Locking ribs 340 and 342 further include front engaging edges 354 and 356, respectively, and can flex about bottom edges 360 and 362, respectively. The ability to flex allows protector 310 to account for manufacturing variances in either inkjet cartridge IC and/or protector 310 to insure proper engagement with latch 312 when in the secured condition. As a result, locking member 338 can have multiple functions. Member 338 can form a rear portion of protective pocket 314 thereby protecting the rear of the inkwell and it can urge the inkjet cartridge toward latch 312 to help maintain the engagement between the inkjet cartridge and the latch.

Protector 310 is attached to inkjet cartridge IC by first directing inkwell IW toward pocket 314. By including lead-in tapers 350 and 352, inkwell IW can be more easily directed into the pocket. To further help the positioning of inkwell IW in pocket 314, front engaging edges 354 and 356 can further include lead-in tapers. As the inkjet cartridge nears the secured condition, well bottom WB approaches the top surface of bottom 330. At this point, cross member 348 of ribs 340 and 342, respectively, nears body bottom BB of the inkjet cartridge. As the inkjet cartridge is further moved toward the secured condition, cross member 348 can engage body bottom BB to help support the inkjet cartridge in the secured condition. By utilizing flexible locking ribs 340 and 342, the ribs can actually produce an upward force to urge inkjet cartridge IC upwardly relative to protector 310 to help flexible latch 312 engage the inkjet cartridge to securely retain the inkjet cartridge in the secured condition. Once in position in pocket 314, the top of the inkjet cartridge is directed toward latch 312 and latch 312 is then positioned on locking protrusion LP. As can be appreciated, during this process the adhesive properties on material UVT can be such that the material is securely fastened to the nozzle plate. Then, once inkjet cartridge IC is in place, the adhesive properties of the UVT can be changed such that the end user can easily remove the material when the cartridge is to be used in an inkjet printer.

As stated above, the desire adhesive properties of material UVT after cure can depend on the configuration of the protector. As can be appreciated, the desired adhesive properties can change if a nozzle pad is used and/or based on the type of shipping the cartridge will be subjected to. In this respect, a nozzle pad can hold material UVT relative to the nozzle plate and can in itself prevent ink leakage. Therefore, when a nozzle pad is utilized, for any embodiment, less adhesion is needed to maintain material UVT relative to the nozzle plate and to seal off the nozzle openings. Conversely, if no nozzle pad is utilized and member 338 is configured to engage the inkjet cartridge to produce a gap between nozzle N and bottom 330, greater adhesion between material UVT and the nozzle plate can be used, and/or, adhesive engagement with the cartridge body can be used, to maintain the position of material UVT during shipping. As stated above, the UV radiation can be masked to reduce the adhesion in only a portion of the material UVT. Masking can also be used to allow the end uses to grasp a portion of the material and/or help start the renewal of the material.

Flexible latch 312 can be designed to engage an existing feature of the inkjet cartridge to work in connection with at least some of the remaining portions of transport protector 310 to maintain the inkjet cartridge in the secured condition. As is stated above, sides 322 and 324 can prevent lateral movement of the inkjet cartridge relative to the protector and member 338 can urge the inkjet cartridge upwardly into engagement with the flexible latch and/or top walls 380 and 382. As is shown, latch 312 is elongated with a bottom edge or portion 390 that is joined to face plate 320 and upwardly extending side edges 392 and 394 which extend between bottom edge 390 and a finger grip 396. In this respect, face plate 320 includes an upwardly opened notch 400 having side edges 402 and 404. Bottom edge 390 of latch 312 is connected to the base of notch opening 400 such that latch 312 can pivot relative to face plate 320 at or near bottom edge 390. However, it should be appreciated, that the use of flexible materials will also allow bending or flexing of latch 312 at any portion along its entire length. Further, latch 312 can be a unified piece with face plate 320.

Latch 312 further includes a lock 410 positioned on the latch that is configured to engage a desired feature of the inkjet cartridge when the inkjet cartridge is in the secured condition. As is shown, lock 410 includes a locking ridge 412 configured to engage a locking protrusion LP of inkjet cartridge IC and a lock opening 414 to allow the locking protrusion to enter lock 410. However, this configuration can be modified without detracting from the invention of this application. In this respect, and for example, lock 410 does not need to include an opening. The lock can be a pocket or other configuration shaped to receive and retain the desired component of the inkjet cartridge. Returning to the figures, locking protrusion LP is designed to releasably retain the inkjet cartridge on an inkjet printer when the inkjet cartridge is in operation. While this is a convenient feature of the inkjet cartridge to lock the protector to the inkjet cartridge, other features can be used in connection with a flexible latch 312 to maintain transport protector 10 relative to inkjet cartridge IC in the secured condition.

In order to help disengage flex latch 312 from the inkjet cartridge, the latch can include finger grip 396 which extends above top walls 380 and 382 and further extends above body top BT of inkjet cartridge IC. Finger grip 396 is U-shaped with an outer wall 420 to create a rigid grip to help direct the flexing of latch 312 to a point near lock 410 to better disengage latch 312 from the inkjet cartridge. While a U-shaped finger grip is shown, other configurations and shapes can be utilized for the finger grip. Further, finger grip 396 does not need to extend above the inkjet cartridge. All that is necessary is to create a portion on latch 12 to allow the user to engage the latch and flex the latch to disengage it from the inkjet cartridge. Once disengaged, the inkjet cartridge can be pivoted and removed from protector 310.

Face plate 320 can further include ribs 430,432,434, and 436. Ribs 430 and 432 can be used to provide shock absorbing characteristics to face place 320 and/or can be used to help maintain the engagement between latch 312 and locking protrusion LP. In this respect, by including inwardly extending ribs, the remaining portions of base plate 320 become spaced from the corresponding surface of the inkjet cartridge. This condition provides shock absorbing characteristics. With respect to latch 312, ribs 430 and 432 can work in connection with face place 320 to produce a slight rearward force to make-up for manufacturing variances in the clip and/or inkjet cartridge to help maintain the engagement between the latch and the inkjet cartridge. In similar fashion, ribs 434 and 436 can provide additional protection to the nozzle portion of the inkjet cartridge.

While a limited number of embodiments of protectors have been shown, the invention of this application can be used in connection with a wide range of protector configurations, including those that provide only a minimal amount of protection for the cartridge.

Further, the invention of this application can also be utilized on bulk shipments of inkjet cartridges where the UVT alone prevents ink seepage.

While considerable emphasis has been placed on the preferred embodiments of the invention illustrated and described herein, it will be appreciated that other embodiments can be made and that many changes can be made in the preferred embodiments without departing from the principals of the invention. It is intended to include all such modifications and alterations insofar as they come within the scope of the appended claims or the equivalents thereof.

Having thus described the invention, it is so claimed:

1. A transport protector for an inkjet cartridge including a cartridge body, an inkwell extending from the cartridge body and a nozzle on the inkwell, said protector comprising a protector body shaped to receive at least a portion of an inkjet cartridge and means to allow UV radiation to penetrate said protector body and cure a UV sensitive material on the inkjet cartridge, wherein said protector further includes a mask to restrict the penetration of the UV radiation such that only a select portion of the UV sensitive material is exposed to the UV radiation.

2. The protector of claim 1, wherein said means includes a UV transparent section on said protector body.

3. The protector of claim 1, wherein said means includes an opening in said protector body.

4. The protector of claim 1, wherein said UV sensitive material is a UV curable tape.

5. The protector of claim 1, wherein said UV sensitive material is on a nozzle of an inkjet cartridge.

6. The protector of claim 5, wherein said protector further includes a nozzle pad and said nozzle pad engaging a nozzle on the inkjet cartridge when said protector is positioned on the inkjet cartridge.

7. The protector of claim 5, wherein said UV sensitive material is a UV curable tape.

8. The protector of claim 5, wherein said protector further includes a mask to restrict the penetration of the UV radiation such that only a select portion of the UV sensitive material is exposed to the UV radiation.

9. The protector of claim 8, wherein said protector further includes a nozzle pad and said nozzle pad engaging a nozzle on the inkjet cartridge when said protector is positioned on the inkjet cartridge, said mask including said nozzle pad.

10. The protector of claim 8, wherein said UV sensitive material is a UV curable tape.

11. The protector of claim 1, wherein said protector body is shaped to receive an inkwell of the inkjet cartridge and protect a nozzle of the inkjet cartridge, said means allowing the UV radiation to be directed toward the nozzle.

12. The protector of claim 11, wherein said protector further includes a nozzle pad and said nozzle pad engaging a nozzle on the inkjet cartridge when said protector is positioned on the inkjet cartridge.

13. The protector of claim 12, wherein said UV sensitive material is a UV curable tape on the nozzle of the inkjet cartridge.

14. The protector of claim 1, wherein said protector is a unified molded component that interengages with the inkjet cartridge to maintain the position of said protector relative to the cartridge.

15. The protector of claim 1, wherein said protector further includes a lid that pivots relative to said protector body and is releaseably engageable with said body such that said protector interengages with the inkjet cartridge to maintain the position of said protector relative to the cartridge.

16. A transport protector for an inkjet cartridge including a cartridge body, an inkwell extending from the cartridge body and a nozzle on the inkwell and wherein a UV sensitive material at least partially covers the nozzle, said protector comprising a protector body shaped to receive at least a portion of an inkjet cartridge including an inkwell and a nozzle of the cartridge, said protector further including means to allow UV radiation to penetrate said protector body and cure the UV sensitive material on the nozzle while said protector is positioned on the inkjet cartridge, wherein said means includes a mask to restrict the penetration of the UV radiation such that only a select portion of the UV sensitive material is exposed to the UV radiation.

17. The protector of claim 16, wherein said UV sensitive material is a UV curable tape.

18. The protector of claim 16, wherein said protector is a unified molded component that interengages with the inkjet cartridge to maintain the position of said protector relative to the cartridge.

19. The protector of claim 16, wherein said protector further includes a nozzle pad and said nozzle pad engaging a nozzle on the inkjet cartridge when said protector is positioned on the inkjet cartridge, said nozzle pad being translucent.

* * * * *